US008936444B2

(12) United States Patent
Drechsel et al.

(10) Patent No.: US 8,936,444 B2
(45) Date of Patent: Jan. 20, 2015

(54) CAPACITIVE LIQUID LEVEL SENSOR

(75) Inventors: Melissa Drechsel, Muskego, WI (US); Shawn Rediske, Lake Mills, WI (US); Ronald Pulvermacher, Sun Prairie, WI (US); David Peters, Sun Prairie, WI (US)

(73) Assignee: Pentair Flow Technologies, LLC, Delavan, WI (US)

( * ) Notice: Subject to any disclaimer, the term of this patent is extended or adjusted under 35 U.S.C. 154(b) by 1011 days.

(21) Appl. No.: 12/150,367

(22) Filed: Apr. 28, 2008

(65) Prior Publication Data

US 2009/0148306 A1 Jun. 11, 2009

Related U.S. Application Data

(60) Provisional application No. 61/012,342, filed on Dec. 7, 2007.

(51) Int. Cl.
*F04B 49/02* (2006.01)
*G01F 23/26* (2006.01)

(52) U.S. Cl.
CPC ..... *F04B 49/02* (2013.01)
USPC ..... 417/53; 417/36; 417/63

(58) Field of Classification Search
CPC .... H01G 5/019; H01G 5/0132; G01F 23/266; G01F 23/263; F04B 49/06; F04B 49/02
USPC ..... 417/36, 53, 63
See application file for complete search history.

(56) References Cited

U.S. PATENT DOCUMENTS

| | | | | |
|---|---|---|---|---|
| 3,443,438 | A * | 5/1969 | Hasler et al. | 73/304 R |
| 3,797,311 | A | 3/1974 | Blanchard et al. | |
| 3,940,020 | A * | 2/1976 | McCrory et al. | 222/52 |
| 4,412,450 | A | 11/1983 | Franz et al. | |
| 4,851,831 | A | 7/1989 | Stern | |
| 4,881,873 | A | 11/1989 | Smith et al. | |
| 5,145,323 | A * | 9/1992 | Farr | 417/36 |
| 5,238,369 | A * | 8/1993 | Farr | 417/18 |
| 5,446,444 | A | 8/1995 | Lease | |
| 5,851,108 | A * | 12/1998 | Clymer et al. | 417/44.1 |
| 6,295,869 | B1 | 10/2001 | Delatte | |
| 6,443,006 | B1 | 9/2002 | Degrave | |
| 6,675,647 | B2 | 1/2004 | Marioni | |
| 6,676,382 | B2 * | 1/2004 | Leighton et al. | 417/40 |

(Continued)

FOREIGN PATENT DOCUMENTS

| | | | |
|---|---|---|---|
| WO | WO2006/096075 | 9/2006 | |
| WO | WO 2006096075 A1 * | 9/2006 | F24D 19/10 |

*Primary Examiner* — Peter J Bertheaud
*Assistant Examiner* — Dominick L Plakkoottam
(74) *Attorney, Agent, or Firm* — Quarles & Brady LLP

(57) ABSTRACT

Described herein is technology for, among other things, controlling a pump submersed in a liquid, where the pump includes a plurality of capacitive sensors. The capacitive sensors include a first capacitive sensor and a second capacitive sensor disposed above the first capacitive sensor. The technology involves sensing liquid levels with the capacitive sensors, activating the pump after the second capacitive sensor detects the liquid in a normal mode of operation, deactivating the pump after the first capacitive sensor no longer detects the liquid in the normal mode of operation, detecting a failure of one or more capacitive sensors, and adjusting the operation of the pump to compensate for the failure of the one or more capacitive sensors.

21 Claims, 4 Drawing Sheets

(56) References Cited

U.S. PATENT DOCUMENTS

| | | | | |
|---|---|---|---|---|
| 6,817,241 | B2 | 11/2004 | Hafer | |
| 6,885,306 | B2 * | 4/2005 | Holzman et al. | 340/606 |
| 7,222,528 | B2 | 5/2007 | Stahlmann et al. | |
| 7,264,449 | B1 | 9/2007 | Harned et al. | |
| 2004/0118433 | A1 * | 6/2004 | Bigott | 134/18 |
| 2007/0051173 | A1 * | 3/2007 | Baniahmad | 73/291 |
| 2007/0113647 | A1 | 5/2007 | Mehlhorn | |
| 2007/0163534 | A1 | 7/2007 | Ketelhohn et al. | |
| 2008/0229819 | A1 * | 9/2008 | Mayleben et al. | 73/304 C |
| 2009/0123295 | A1 * | 5/2009 | Abbott | 417/36 |

* cited by examiner

CAPACITIVE LIQUID LEVEL SENSOR

RELATED APPLICATIONS

This application claims priority to U.S. Provisional Application No. 60/012,342, filed Dec. 7, 2007, the entire contents of which are incorporated herein by reference.

BACKGROUND

1. Field

Embodiments of the present invention generally relate to the field of control circuits for pump motors. More specifically, embodiments relate to liquid level control circuits which automatically maintain the liquid level within a predetermined range.

2. Background

In sump and water tanks, for example, the liquid level should be maintained within a predetermined range for proper functioning of the tank. Many prior art devices automatically control the liquid level within the tank by activating a pump when the liquid rises above a first predetermined level and deactivating the pump when the liquid level falls below a second predetermined level. Some conventional devices use mechanical or moving parts such as mechanical switches operated by rubber diaphragms, springs, rods, floats, or balls, all of which may tend to wear out or malfunction over time.

Other conventional devices use electrical or optical probes positioned within the tank to determine the liquid level and control the pump accordingly. For example, self-heating thermistors or conductivity probes may be used. However, such conventional systems using probes may be sensitive to humidity, moisture, changing temperatures, and varying voltage levels in the sensing circuit, all of which may produce erroneous results and subject the probes to wear. Also, contamination of the probes may adversely effect their performance. The probes and their associated circuitry may be adjusted to improve performance, but making the adjustments may be inconvenient and expensive.

Employing capacitive sensors for liquid level control provides advantages including the prevention of triggering from transient water imbalances, such as splashes or waves, by precisely defining the required charging time of the capacitive sensors. However, build-up of certain materials, especially dielectric materials, on a capacitive sensor can cause the sensor to detect a false positive. As a result, the pump may be caused to run too much in some cases, or not enough in other cases, thereby causing a flood.

SUMMARY

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

An embodiment of the present invention is directed to a method for controlling a pump submersed in a liquid, where the pump includes a plurality of capacitive sensors. The capacitive sensors include a first capacitive sensor and a second capacitive sensor disposed above the first capacitive sensor. The method includes sensing liquid levels with the capacitive sensors, activating the pump after the second capacitive sensor detects the liquid in a normal mode of operation, deactivating the pump after the first capacitive sensor no longer detects the liquid in the normal mode of operation, detecting a failure of one or more capacitive sensors, and adjusting the operation of the pump to compensate for the failure of the one or more capacitive sensor.

Another embodiment of the present invention is directed to an apparatus for disposing of a liquid in a reservoir. The apparatus includes a pump and a liquid level sensing circuit for determining when said liquid reaches predetermined levels in the reservoir. The liquid level sensing circuit includes a capacitive sensor for sensing one of the predetermined levels. The apparatus further includes a control circuit coupled with the pump and the liquid level sensing circuit and responsive to the liquid level sensing circuit, where the control circuit is operable to control the pump. The control circuit is further operable to detect a failure of the capacitive sensor and adjust operation of the pump to compensate for the failure.

Another embodiment of the present invention is directed to an apparatus for disposing of a liquid in a reservoir. The apparatus includes a pump and a liquid level sensing circuit for determining when the liquid reaches predetermined levels in the reservoir. The liquid level sensing circuit includes a first capacitive sensor for sensing a first liquid level and a second capacitive sensor disposed above the first capacitive sensor for sensing a second fluid level. The apparatus further includes a control circuit coupled with the pump and the liquid level sensing circuit and responsive to the liquid level sensing circuit. The control circuit is operable to control said pump. The control circuit is further operable to detect a failure of the second capacitive sensor when the second capacitive sensor reports the presence of liquid and the first capacitive sensor does not.

Another embodiment of the present invention is directed to an apparatus for disposing of a liquid in a reservoir. The apparatus includes a pump and a liquid level sensing circuit for determining when the liquid reaches predetermined levels in the reservoir. The liquid level sensing circuit includes a first capacitive sensor for sensing a first liquid level and a second capacitive sensor disposed above the first capacitive sensor for sensing a second fluid level. The apparatus further includes a control circuit coupled with the pump and the liquid level sensing circuit and responsive to the liquid level sensing circuit. The control circuit is operable to control said pump. The control circuit is further operable to detect a failure of said first capacitive sensor when said first capacitive sensor continues to report the presence of liquid after said control circuit has activated said pump for a predetermined amount of time.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Overview

Briefly stated, various embodiments provide for methods and apparatuses for capacitive sensor-based control of a pump submersed in a liquid, such as a sump pump, a bilge pump, or the like. Embodiments use one or more capacitive sensors to detect the presence of the liquid at given levels and control the operation of the pump based thereon. Furthermore embodiments are able to detect a failure of one or more of the sensors and adjust the operation of the pump to take the fouled sensor(s) into account.

Exemplary Pump Control Operations

Figure 1:
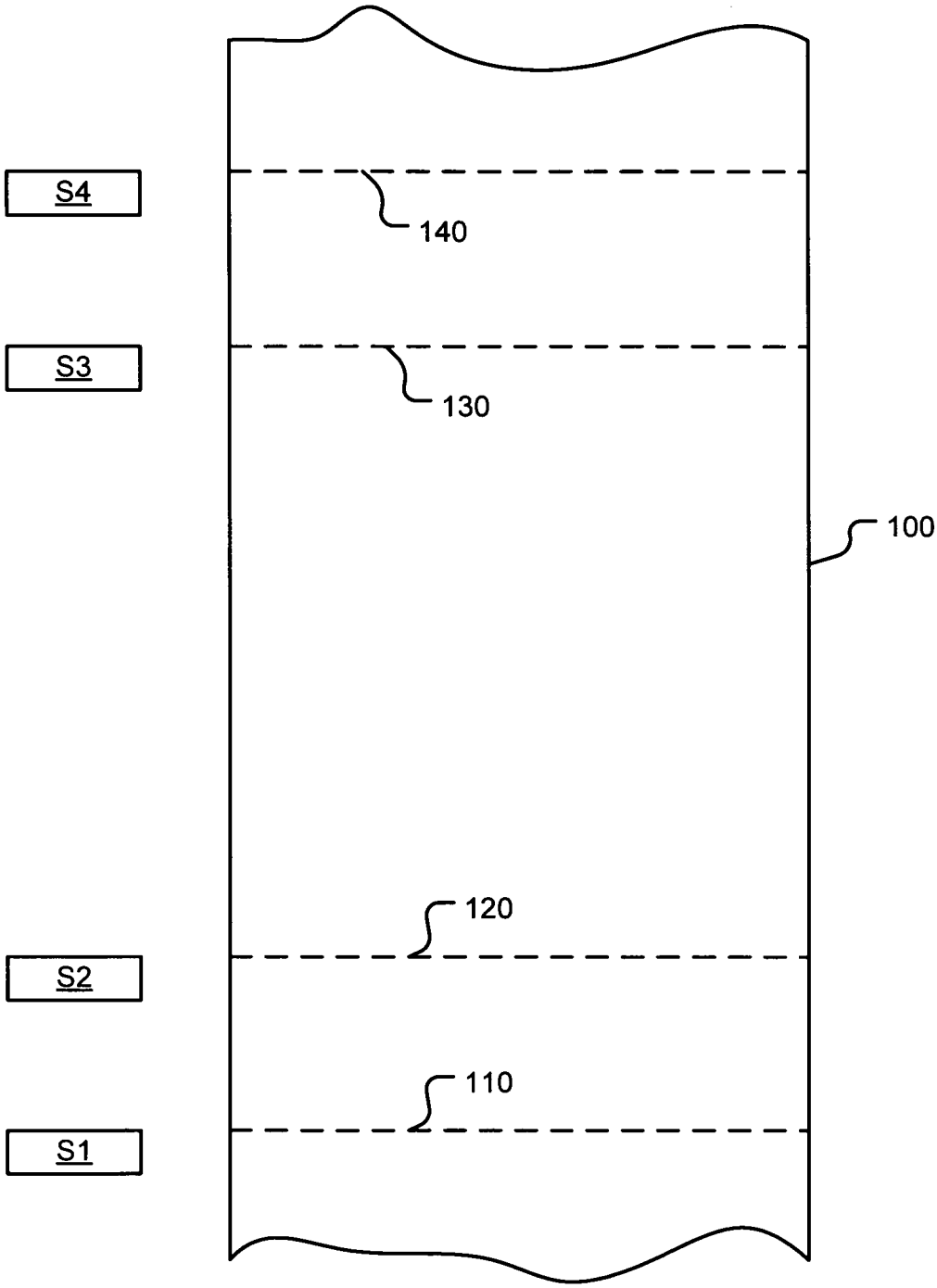
FIG. 1 illustrates a plurality of capacitive sensors positioned at varying heights relative to a fluid reservoir, in accordance with various embodiments of the present invention.
Figure 2:
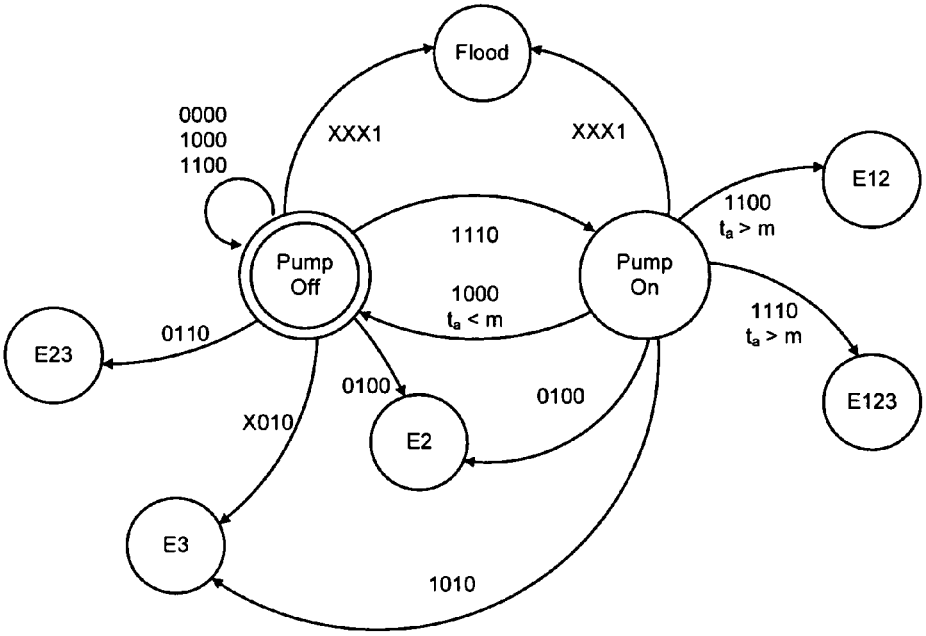
FIG. 2 is a state diagram illustrating various states of operation of a pump submersed in a liquid and having a plurality of capacitive sensors, in accordance with various embodiments of the present invention.

With reference to FIGS. 1 and 2, exemplary operations will be described for controlling a pump submersed in a liquid, in accordance with various embodiments of the present invention. FIG. 1 illustrates a plurality of capacitive sensors S1-S4 positioned at varying heights relative to a fluid reservoir 100. Although four sensors S1-S4 are depicted in FIG. 1, it should be appreciated that any number of such sensors may be used. Each of the sensors is operable to detect the presence of a liquid in the reservoir 100 at corresponding levels. In particular, sensor S1 detects liquid at level 110, sensor S2 detects liquid at level 120, sensor S3 detects liquid at level 130, and sensor S4 detects liquid at level 140. Assuming all sensors are functioning properly, as liquid begins to fill the reservoir 100, the sensors will detect the presence of the liquid in successive order (i.e., first S1, then S2, then S3, and finally S4).

FIG. 2 is a state diagram illustrating various states of operation of a pump submersed in a liquid and having a four capacitive sensors S1-S4. While particular states/operations are depicted in FIG. 2, such states/operations are exemplary. Accordingly, embodiments may perform other operations not depicted in FIG. 2. Similarly, embodiments may not necessarily perform all the operations of FIG. 2. For example, in the illustrated embodiment, S4 is used as a failsafe or alarm sensor. However, other embodiments may be achieved that do not utilize a failsafe sensor.

Each transition between states is associated with a four-bit binary number, with the leftmost bit representing S1, the rightmost bit representing S4, etc. A "1" indicates that a given sensor detects the presence of liquid, a "0" indicates the converse, and a "X" indicates that either reading may apply. States comprising a designation of the letter "E" followed by one or more numbers indicates an error or failure of the corresponding sensor(s). For example, "E13," denotes failures of S1 and S3.

Initially, operation starts in the "Pump Off" state, with the pump accordingly being turned off. During normal operation of a pump having the sensor configuration depicted in FIG. 1, the pump control will toggle between "Pump Off" and "Pump On" states. For example, as the reservoir fills with liquid, S1 will become covered (1000), then S2 (1100), and then S3 (1110). Once S3 detects the presence of the liquid, the pump is turned on (i.e., "Pump On" state). The pump continues to pump out the liquid until S2 is uncovered again (1000). The term $t_a$ is the amount of time for which the pump has been activated. So long as no alarm conditions are detected, the illustrated embodiment will continue to activate the pump when S3 becomes covered and deactivate the pump when S2 becomes uncovered.

During the course of operation, it is possible that one or more sensors may fail, such as when a build-up of a dielectric material interferes with a sensor's reading. In such a case, the fouled sensor will report the presence of liquid, even when liquid is not actually present (i.e., a false positive). Upon detecting a failed sensor, an alarm condition may be activated. The alarm condition may be reported to a user visually, audibly, or a combination of both. Table 1 illustrates an example alarm scheme that may be utilized by various embodiments. It is appreciated that other alarm schemes may be utilized, in accordance with other embodiments. Such a failure of a sensor may be detected in a number of ways.

TABLE 1

Sample Alarm Scheme

| Alarm | Diagnosis |
|---|---|
| A1 | Fouled sensor |
| A2 | Replace pump |
| A3 | Flood |

In one embodiment, the failure of a sensor may be detected when the failed sensor reports the presence of liquid, but one or more sensors disposed below the failed sensor does not. For example, if S3 reports the presence of liquid and S2 does not (X010), a failure is detected with respect to S3. Similarly if both S2 and S3 sense liquid and S1 does not (0110), failures are detected with respect to both S2 and S3.

In one embodiment, the failure of a sensor may be detected when the failed sensor continues to report the presence of liquid after the pump has been activated for a predetermined amount of time. For example, if S1 and S2 continue to report the presence of liquid after the pump has been on for 30 seconds or more (1100, $t_a$>30 s), failures of S1 and S2 may be detected.

Using the above techniques, a pump control apparatus may detect virtually any combination of fouled or failed capacitive sensors. In response to detecting one or more failed capacitive sensors, embodiments are capable of adjusting the operation of the pump to compensate for the failed sensor(s). In other words, upon detection of a failed sensor, operation of the pump may go into an error state in which the switching of the pump deviates from normal operation.

For example, as the illustrated embodiment is described above, the pump normally turns on when S3 becomes covered and then turns off when S2 becomes uncovered again. If a failure of S2 is detected (i.e., E2), operation of the pump may be adjusted so that the pump turns on when S3 becomes covered and turns off when S1 becomes uncovered, or, alternatively, turns off after a predetermined amount of time (e.g., 30 seconds).

By way of another example, if a failure of S3 is detected (i.e., E3) operation of the pump may be adjusted so that the pump turns on after S2 becomes covered and turns off after S1 becomes uncovered. Because S1 and S2 are illustrated in FIG. 1 as being closer together as compared to S2 and S3, E3 may be a shortened cycle state, where a delay period may be included in the operation of pump, such as the pump turning on 15 seconds after S2 becomes covered and turning off 15 seconds after S1 becomes uncovered. Alternatively, the E3 state may involve turning the pump on after S4 becomes covered and turning the pump off after S2 becomes uncovered. In this example, however, S4 may no longer serve as a failsafe sensor.

Table 2 illustrates all the various possible error states for a preferred embodiment implementing four level sensors, such as illustrated in FIGS. 1 and 2, as well as sample adjustments to the operation of the pump that may be made based on each error state. The adjustments described in Table 2 are exemplary and therefore are not exhaustive of all possible sensor states leading to the detection of a fouled sensor, nor of all possible adjustments made in response to detecting one or more failed sensors.

In one embodiment, the sensors are advantageously checked on a per cycle basis. Thus, it is possible that in one cycle, a failure may be detected with respect to S3, for example. Accordingly, the pump will go into a modified mode of operation in which the pump turns on after S2 becomes covered and turns off after S1 becomes uncovered. However, it is conceivable that a number of cycles later, the conditions that were causing S3 to fail no longer exist. For instance, a film or mineral deposit on the side of the liquid reservoir 100 that was previously causing S3 to report false positives may get washed away. Once the obstruction is washed away, S3 begins to correctly report the presence (or absence) of liquid again. Thus, in the following cycle, it is determined that S3 is no longer considered failed, and the pump returns to normal operation.

TABLE 2

Adjustments to Pump Operation by Error State

| Error | Condition Sensor Fouled | | | | Run time before | | | Condition to turn alarm and |
|---|---|---|---|---|---|---|---|---|
| State | 1 | 2 | 3 | 4 | alarm/action | Alarm | Alarmed Pump Action | alarmed action off |
| E1 | X | | | | n/a | None | None | None |
| E2 | | X | | | S1 uncovered | A1 | Off when S1 uncovered or t = 30 s<br>On when S3 covered<br>Repeat | Normal sensor sequence (S1 => S1 + S2 => S1 + S2 + S3 => S1 + S2 => S1) |
| E3 | | | X | | S1 uncovered + 15 s | A1 | Off when S1 uncovered + 15 s<br>On when S2 covered + 15 s<br>Repeat | S3 is uncovered |
| E4 | | | | X | S1 uncovered + 15 s | A1 | Off when S1 uncovered + 15 s<br>On when S2 covered + 15 s<br>Repeat | Normal sensor sequence (S1 => S1 + S2 => S1 + S2 + S3 => S1 + S2 => S1) |
| E12 | X | X | | | 30 s | A1 | Off when S3 uncovered + 30 s<br>On when S3 covered<br>Repeat | Normal sensor sequence (S1 => S1 + S2 => S1 + S2 + S3 => S1 + S2 => S1) |
| E13 | X | | X | | S1 uncovered + 15 s | A1 | Off when S1 uncovered + 15 s<br>On when S2 covered + 15 s<br>Repeat | S3 is uncovered |
| E14 | X | | | X | S1 uncovered + 15 s | A1 | Off when S1 uncovered + 15 s<br>On when S2 covered + 15 s<br>Repeat | Normal sensor sequence (S1 => S1 + S2 => S1 + S2 + S3 => S1 + S2 => S1) |
| E23 | | X | X | | 30 s or until S1 uncovered | A1 | Off when t = 30 s or S1 uncovered<br>On when S1 covered<br>Repeat | Normal sensor sequence (S1 => S1 + S2 => S1 + S2 + S3 => S1 + S2 => S1) |
| E24 | | X | | X | S1 uncovered | A1 | Off when S1 uncovered or t = 30 s<br>On when S3 covered<br>Repeat | Normal sensor sequence (S1 => S1 + S2 => S1 + S2 + S3 => S1 + S2 => S1) |
| E34 | | | X | X | S1 uncovered + 15 s | A1 | Off when S1 uncovered + 15 s<br>On when S2 covered + 15 s<br>Repeat | Normal sensor sequence (S1 => S1 + S2 => S1 + S2 + S3 => S1 + S2 => S1) |
| E123 | X | X | X | | 30 s | A1 | Off when S4 uncovered + 30 s<br>On when S4 covered<br>Repeat | Normal sensor sequence (S1 => S1 + S2 => S1 + S2 + S3 => S1 + S2 => S1) |
| E134 | X | | X | X | S1 uncovered + 15 s | A1 | Off when S1 uncovered + 15 s On when S2 covered + 15 s Repeat | Normal sensor sequence (S1 => S1 + S2 => S1 + S2 + S3 => S1 + S2 => S1) |
| E124 | X | X | | X | S1 uncovered | A1 | Off when S1 uncovered or t = 30 s<br>On when S3 covered<br>Repeat | Normal sensor sequence (S1 => S1 + S2 => S1 + S2 + S3 => S1 + S2 => S1) |
| E234 | | X | X | X | 30 s | A1 | Off when S1 uncovered or t = 30 s<br>On when S1 covered<br>Repeat | Normal sensor sequence (S1 => S1 + S2 => S1 + S2 + S3 => S1+S2 => S1) |

TABLE 2-continued

| Adjustments to Pump Operation by Error State | | | | | | | | |
|---|---|---|---|---|---|---|---|---|
| Error State | Condition Sensor Fouled 1 | 2 | 3 | 4 | Run time before alarm/action | Alarm | Alarmed Pump Action | Condition to turn alarm and alarmed action off |
| E1234 | X | X | X | X | 30 s | A3 | Off when t = 30 s, Off for 5 s On for t ≤ 30 s Repeat | Any sensor is uncovered |
| | Motor Amperage < 40% or >140% of nominal amperage (determined in 1st 10 cycles after pump is recalibrated) | | | | 5 s | A2 | None | Current returns to normal for more than 2 s |

Exemplary Liquid Disposal Apparatus

Figure 3:
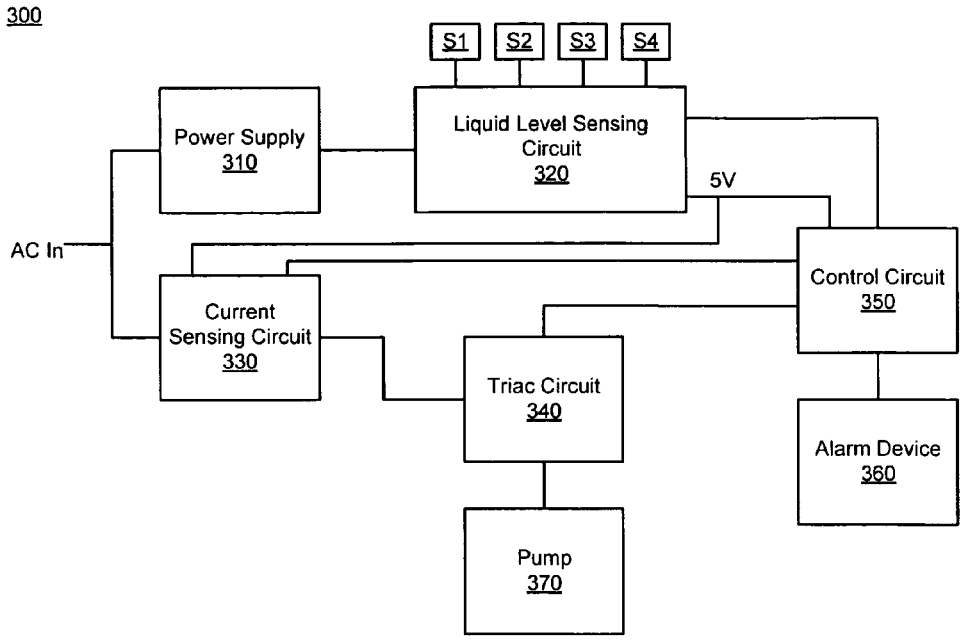
FIG. 3 is a block diagram of an apparatus for disposing of a liquid in a reservoir, in accordance with various embodiments of the present invention.

FIG. 3 illustrates a block diagram of an apparatus 300 for disposing of a liquid in a reservoir, in accordance with various embodiments of the present invention. Although four sensors S1-S4 are illustrated in FIG. 3, any number of capacitive sensors may be used. The apparatus 300 includes a power supply 310, a pump 370, and a triac circuit 340 for switching/driving the pump. The apparatus further includes a liquid level sensing circuit 320, which is coupled with the capacitive sensors S1-S4 and is operable to generate an output based on the readings of the sensors S1-S4.

In one embodiment, the liquid level sensing circuit 320 includes an electric field sensor, which is operable to create an electric field by applying a low radio frequency sine wave to the sensors S1-S4. The sensors S1-S4 may be individual electrodes which form virtual capacitors with a wall of the reservoir or earth-ground. Accordingly, the amplitude and phase of the sinusoidal wave at the electrodes are affected by objects in proximity. The voltage measured at a given electrode is an inverse function of the capacitance between the electrode being measured, the surrounding electrodes, and other objects in the electric field surrounding the electrode. Thus, in one embodiment, the sensors S1-S4 output a low voltage when liquid is present and a high voltage when liquid is not.

The apparatus further includes a control circuit 350 coupled with the liquid level sensing circuit 320 and the triac circuit 340. The control circuit 350 is operable to control the pump 370 via the triac circuit 340 and responsive to liquid level information from the liquid level sensing circuit 320. Thus, during normal operation, the control circuit toggles the pump on and off as necessary to dispose of the liquid in the reservoir. For example, as described above and as shown in FIG. 2, the control circuit may ordinarily cause the pump to turn on after S3 detects the liquid and to turn back off after S2 no longer detects the liquid.

The control circuit 350 is further operable to detect a failure of one or more of the sensors S1-S4 based on the liquid level information received from the liquid level sensing circuit 320. The control circuit 350 may detect a failure of a sensor in a manner similar to that described above with reference to FIGS. 1 and 2, but is not limited as such.

For example, the control circuit 350 may detect the failure of a sensor when the information received from the liquid level sensing circuit 320 reports the presence of liquid with respect to the failed sensor, but not with respect to one or more sensors disposed below the failed sensor. The control circuit 350 may also detect a failure of a sensor when the liquid level sensing circuit 320 continues to report the presence of liquid at a particular sensor after the pump has been activated for a predetermined amount of time.

Using the above techniques, the pump control apparatus 300 may detect virtually any combination of fouled or failed capacitive sensors. Upon detection of a failed sensor, the control circuit 350 is operable to adjust the operation of the pump 370 in order to compensate for the failed sensor(s). In other words, upon detection of a failed sensor, the control circuit 350 may operate the pump 370 in an error state in which the switching of the pump via the triac circuit 340 deviates from normal operation. This may be achieved in a manner similar to that described above with reference to FIGS. 1 and 2 and Table 2, but is not limited as such.

Further, upon detection of a failed sensor, the control circuit 350 may activate an alarm condition. The activation of the alarm condition may include activating an alarm device 360. The alarm device 360 may include visual alarm, such as an LED or any other visual display, an audible alarm, or both. For enhanced visibility and audibility, the alarm device may be disposed along a power cable of the apparatus 300, preferably close the power plug portion of the power cable.

The apparatus 300 may also include a current sensing circuit 330 coupled with the triac circuit 340 and the control circuit 350. The current sensing circuit 330 is operable to sense a current through the triac circuit 340 and output a signal to the control circuit 350 based thereon. The control circuit 350 may then use the signal from the current sensing circuit 330 to determine whether the pump 370 is operating in an appropriate range. If the current through the triac circuit 340 is outside of a predetermined range, the control circuit 350 may then activate a corresponding alarm condition, such as through the alarm device 360.

In one embodiment, the range of acceptable current values may be derived based upon an average current value that is determined by the control circuit 350 "on the fly." For example, the average current value may be determined by taking the average of the current from each of the first ten pump activations. The range of acceptable current values may then be average current value plus or minus a tolerance value, such as ±35%.

Figure 4:
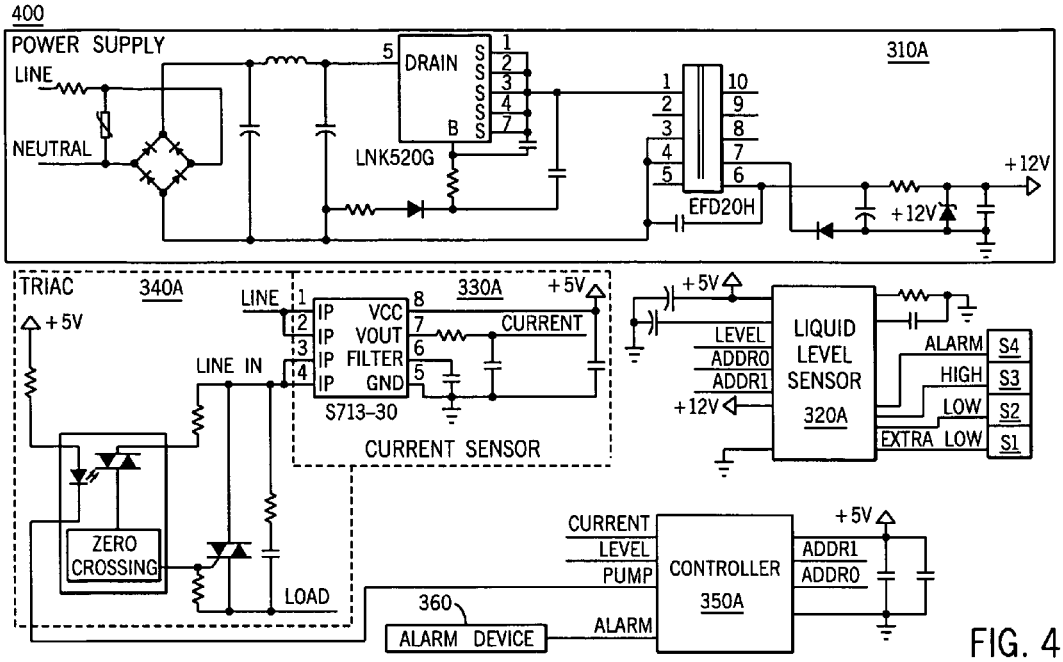
FIG. 4 is a schematic of a circuit for controlling a pump submersed in a liquid and having a plurality of capacitive sensors, in accordance with various embodiments of the present invention.

FIG. 4 is a schematic of a circuit 400 for controlling a pump 370 submersed in a liquid and having a plurality of capacitive sensors S1-S4, in accordance with an embodiment of the present invention. Circuit 400 includes a power supply 310A, as well as a triac circuit 340A for switching/driving a pump 370 via the output LOAD.

The circuit 400 also includes a liquid level sensing circuit 320A is coupled with the capacitive sensors S1-S4. Similar to circuit 320 described above, the liquid level sensing circuit 320A may include an electric field sensor, which is operable to create an electric field by applying a low radio frequency sine wave to the sensors S1-S4. Thus, in the illustrated embodiment, the sensors S1-S4 output a low voltage when liquid is present and a high voltage when liquid is not.

Based on the signals received at the address inputs ADDR0 and ADDR1, the liquid level sensing circuit 320A takes a reading of a particular sensor and determines, based on the reading, whether the sensor is reporting the presence of liquid. The liquid level sensing circuit 320A then sets the output LEVEL based on the reading of the selected sensor. In one embodiment, LEVEL may be a simple binary output (e.g., "1" for liquid and "0" for no liquid).

The circuit 400 also includes a current sensing circuit 330A coupled with the triac circuit 340A. The current sensing circuit 330A is operable to sense a current through the triac circuit 340A through node LINE IN and output the signal CURRENT based thereon. The CURRENT signal may then be used to determine whether the pump 370 is operating in an appropriate range.

The circuit 400 also includes a control circuit 350A coupled with the liquid level sensing circuit 320A, the triac circuit 340A, and the current sensing circuit 330A. The control circuit 350A is operable to control the pump 370 via the triac circuit 340, responsive to liquid level information received from the liquid level sensing circuit 320A. The control circuit 350A activates and deactivates the pump 370 by applying corresponding voltages at the PUMP node. During normal operation, the control circuit toggles the pump on and off as necessary to dispose of the liquid in the reservoir. For example, as described above and as shown in FIG. 2, the control circuit may ordinarily cause the pump to turn on after S3 detects the liquid and to turn back off after S2 no longer detects the liquid.

During pump operation, the control circuit 350A obtains liquid level information from the liquid level sensing circuit 320A. In one embodiment, the control circuit obtains this information by periodically querying the liquid level sensing circuit 320A for the status of each sensor S1-S4. The control circuit 350A may select a particular sensor using the lines ADDR0 and ADDR1. In response, the liquid level sensing circuit 320A outputs a the signal LEVEL, which corresponds to the liquid detection status of the selected sensor.

The control circuit 350A is further operable to detect a failure of one or more of the sensors S1-S4 based on the liquid level information received from the liquid level sensing circuit 320A. The control circuit 350A may detect a failure of a sensor in a manner similar to that of control circuit 350 described above with reference to FIGS. 1-3, but is not limited as such.

Using the above techniques, the circuit 400 may detect virtually any combination of fouled or failed capacitive sensors. Upon detection of a failed sensor, the control circuit 350A is operable to adjust the operation of the pump 370 in order to compensate for the failed sensor(s). In other words, upon detection of a failed sensor, the control circuit 350A may operate the pump 370 in an error state in which the switching of the pump via the triac circuit 340A deviates from normal operation. This may be achieved in a manner similar to that described above with reference to FIGS. 1-3 and Table 2, but is not limited as such.

Further, upon detection of a failed sensor, the control circuit 350A may activate an alarm condition. The activation of the alarm condition may include the activation of alarm device 360. As above, the alarm device 360 may include visual alarm, such as an LED or any other visual display, an audible alarm, or both.

The control circuit 350A may also control the operation of the pump 370 in response to the CURRENT output from the current sensing circuit 330A. For example, the pump 370 may have a range of operating currents in which it may operate safely. The control circuit 350A may use the CURRENT output of the current sensing circuit 330A to derive the current through the triac circuit 340A, and thus through the pump 370, and determine whether the pump 370 is operating within the appropriate range. If the current through the triac circuit 340A is outside of the predetermined range, the control circuit 350A may then activate a corresponding alarm condition, such as through the alarm device 360.

Thus, various embodiments provide for technology for detecting liquid levels using capacitive sensors, while at the same time being able to detect a failed sensor. Because such embodiments are thereby aware of the failed sensor(s), they allow for intelligent operation of sump pumps, bilge pumps, and the like, by adjusting the operation of such pumps to compensate for the failed sensor(s). This intelligent operation allows for more efficient liquid removal, as well as guards against pump motor burn-out in situations when a sensor becomes "stuck on".

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A method of controlling a pump for use with a plurality of capacitive sensors, the plurality of capacitive sensors including a first capacitive sensor and a second capacitive sensor positioned above the first capacitive sensor, the method comprising:

sensing liquid levels with the plurality of capacitive sensors in a normal mode of operation;

activating the pump to pump the liquid after the second capacitive sensor detects the liquid in the normal mode of operation;

deactivating the pump after the first capacitive sensor no longer detects liquid in the normal mode of operation;

detecting a failure of at least one of the plurality of capacitive sensors;

entering a first error mode of operation from a plurality of error modes of operation after detecting the failure, the first error mode of operation allowing continued activating and deactivating of the pump to allow the pump to continue to pump the liquid based on sensing the liquid levels with at least one of the remaining plurality of capacitive sensors that is functioning, and entering a second error mode of operation from the plurality of error modes when none of the plurality of capacitive sensors are functioning, the second error mode of operation allowing continued activating and deactivating of the pump to allow the pump to continue to pump the liquid by periodically activating the pump for a first predetermined time period, and pausing for a second predetermined time period between the periodic pump activations;

actively checking one or more of the plurality of capacitive sensors that failed for determining if one or more of the plurality of capacitive sensors that failed are no longer considered failed; and returning to the normal mode of operation if all the plurality of capacitive sensors that failed are no longer considered failed.

2. The method of claim 1 and further comprising activating an alarm condition after detecting the failure.

3. The method of claim 2 wherein activating the alarm condition includes illuminating an LED.

4. The method of claim 2 wherein activating the alarm condition includes sounding an audible alarm.

5. The method of claim 1 and further comprising detecting a failure of the second capacitive sensor when the second capacitive sensor detects liquid and the first capacitive sensor does not detect liquid.

6. The method of claim 1 and further comprising activating the pump when the first capacitive sensor detects liquid; and deactivating the pump when liquid is no longer detected by a third capacitive sensor positioned below the first capacitive sensor.

7. The method of claim 1 and further comprising activating the pump when the first capacitive sensor detects liquid; and deactivating the pump after a predetermined time period.

8. The method of claim 1 wherein the plurality of capacitive sensors includes a third capacitive sensor positioned below the first capacitive sensor, and further comprising:

detecting failures of the first capacitive sensor and the second capacitive sensor;

activating the pump after the third capacitive sensor detects liquid; and deactivating the pump at least one of after a predetermined time period and after liquid is no longer detected by the third capacitive sensor.

9. The method of claim 8 and further comprising detecting failures of the first capacitive sensor and the second capacitive sensor when the first capacitive sensor and the second capacitive sensor detect liquid and the third capacitive sensor does not detect liquid.

10. The method of claim 8 and further comprising detecting failures of the first capacitive sensor and the second capacitive sensor when the first capacitive sensor and the second capacitive sensor continue to detect liquid after the pump has been activated a predetermined time period.

11. The method of claim 1 and further comprising detecting a failure of the first capacitive sensor when the first capacitive sensor continues to detect liquid after the pump has been activated a predetermined time period; activating the pump when the second capacitive sensor detects liquid; and deactivating the pump when liquid is no longer detected by a third capacitive sensor positioned below the first capacitive sensor.

12. The method of claim 1 and further comprising detecting failures of all of the plurality of capacitive sensors when the plurality of capacitive sensors continue to detect liquid after the pump has been activated the first predetermined time period.

13. The method of claim 1 and further comprising detecting a failure of the pump; and activating an alarm condition when the pump fails.

14. The method of claim 13 and further comprising sensing an electrical current through the pump; determining that the electrical current is outside of a predetermined boundary; and activating an alarm condition.

15. A pump system for removing liquid from a reservoir, the system comprising:

a pump;

a liquid level sensing circuit to determine when the liquid reaches predetermined levels in the reservoir;

a first capacitive sensor connected to the liquid level sensing circuit, the first capacitive sensor sensing a first liquid level;

a second capacitive sensor positioned above the first capacitive sensor and connected to the liquid level sensing circuit, the second capacitive sensor sensing a second liquid level;

a control circuit connected to the pump and the liquid level sensing circuit, the control circuit detecting a failure of the second capacitive sensor when the second capacitive sensor reports the presence of liquid and the first capacitive sensor does not report the presence of liquid, the control circuit exiting a normal mode of operation and entering a first of a plurality of error modes of operation to compensate for the failure of the second capacitive sensor, the first error mode of operation allowing the control circuit to continue activating and deactivating the pump to allow the pump to continue to pump the liquid from the reservoir based on sensing the liquid levels with only the first capacitive sensor, and entering a second error mode of operation from the plurality of error modes when none of the plurality of capacitive sensors are functioning, the second error mode of operation allowing continued activating and deactivating of the pump to allow the pump to continue to pump the liquid by periodically activating the pump for a first predetermined time period, and pausing for a second predetermined time period between the periodic pump activations; and the control circuit further actively checking at least one of the failed first and second capacitive sensors to determine if at least one of the first and second capacitive sensors are no longer considered failed, and returning to the first error mode of operation if one of the first and the second capacitive sensors are no longer considered failed and returning to the normal mode of operation if both the first and the second capacitive sensors are no longer considered failed.

16. The system of claim 15 wherein the liquid level sensing circuit includes an electric field generator for generating an electric field that is used by the capacitive sensor to sense the liquid.

17. The system of claim 15 and further comprising a triac circuit connected to the control circuit, the control circuit controlling the pump with the triac circuit.

18. The system of claim 17 and further comprising a current sensor connected to the control circuit and the triac circuit, the current sensor sensing a current through the pump and providing a signal proportional to the sensed current to the control circuit, the control circuit controlling operation of the pump based at least in part on the signal.

19. The system of claim 18 wherein the control circuit activates an alarm condition in response to the current sensor detecting that the current is outside of a predetermined range.

20. The system of claim 15 and further comprising a third capacitive sensor positioned below the first capacitive sensor for sensing a third fluid level; the control circuit activating the pump when liquid is detected by the second capacitive sensor; the control circuit deactivating the pump when liquid is no longer detected by the first capacitive sensor; and the control circuit compensating for the detected failure of the second capacitive sensor by activating the pump when liquid is detected by the first capacitive sensor and deactivating the pump when liquid is no longer detected by the third capacitive sensor.

21. The system of claim 15 wherein a first distance between the first capacitive sensor and the second capacitive sensor is greater than a second distance between the first capacitive sensor and the third capacitive sensor.

* * * * *